United States Patent [19]

Lubozynski

[11] 4,327,516

[45] May 4, 1982

[54] FOLDABLE STRUCTURE

[76] Inventor: Lisa J. Lubozynski, 212 Kensington Pl., Syracuse, N.Y. 13210

[21] Appl. No.: 198,916

[22] Filed: Oct. 20, 1980

[51] Int. Cl.[3] ..... A63H 33/10; F16G 13/06; A63H 33/00

[52] U.S. Cl. ..... 46/31; 46/16; 46/1 R; 493/959; 493/958; 59/89

[58] Field of Search ..... 46/1 R, 1 L, 30, 31; 272/8 N, 27 N; 40/533, 539; 59/80, 78, 84, 83, 91, DIG. 1, 13, 14, 86, 88, 89; 434/160; 273/155; 493/957, 958, 966, 959

[56] References Cited

U.S. PATENT DOCUMENTS

| | | | |
|---|---|---|---|
| D. 246,544 | 11/1977 | Brinkley | 273/155 |
| 2,046,985 | 7/1936 | Wilkins | 493/966 |
| 2,539,891 | 1/1951 | Carr et al. | 59/DIG. 1 |
| 3,201,894 | 8/1965 | Resch | 46/1 R |
| 3,518,785 | 7/1970 | Behr | 273/155 |
| 3,596,396 | 8/1971 | Thomson | 46/1 R |
| 3,611,617 | 10/1971 | Foster et al. | 46/1 L |
| 3,962,816 | 6/1976 | Sarid | 46/1 L |
| 4,142,321 | 3/1979 | Coppa | 273/155 |

FOREIGN PATENT DOCUMENTS

| | | | |
|---|---|---|---|
| 529428 | 4/1940 | United Kingdom | 493/966 |

*Primary Examiner*—Gene Mancene
*Assistant Examiner*—Michael J. Foycik
*Attorney, Agent, or Firm*—Bruns & Jenney

[57] ABSTRACT

A manipulatable structure that contains a series of linked units. Each unit contains a plurality of rhombic-shaped panels that are hinged along their oblique edges to create a collapsible enclosure that can be used to create two dimensional patterns when the panels are folded into one of two available common planes or any number of three dimensional structures when positioned between the two common planes. Each unit, in turn, is hinged to an adjacent unit along abutting oblique corners to create a chain that can be symmetrically formed by linking the units in a repeating linear pattern or asymmetrically formed by linking the units in a random fashion.

7 Claims, 4 Drawing Figures

10
3X
2X
X
17
ZZ
Z
15
12
25
16

12
10
19
25
15

10
12
19
25
15

10
12
15
19

FOLDABLE STRUCTURE

BACKGROUND OF THE INVENTION

The present invention relates to a foldable structure and, in particular, to a structure that can be manipulated by the user to create different configurations. More specifically, this invention relates to a foldable structure that can be used either as an amusement device or as a device for developing various decorative and artistic shapes and patterns.

A knockdown kit is disclosed in U.S. Pat. No. 3,611,617 that contains a relatively large number of pieces from which different forms can be generated. The forms, in turn, are hinged together in assembly using pins to create a chain. As disclosed in this patent, each part in the chain must be assembled in a very precise manner and the finished chain is a rather delicate structure that is highly susceptible to breakage. Although the configuration of the chain can be altered by moving the forms about the pins, the shape or pattern of the forms themselves, once assembled, cannot be changed. Accordingly, the degree of movement afforded by the device is rather limited. The many parts contained in the kit are relatively small and thus can be easily mislaid or lost. The kit itself, on the other hand, is rather large because of the number of parts involved. It therefore can not be easily transported and its use is generally restricted to a particular location such as a game room or the like.

A foldable device that relies upon the Japanese art form known as origami to develop modular shapes is disclosed in U.S. Pat. No. 4,033,068. The module, as it is developed, contains a number of points that are arranged to slip into a similar number of pockets to build segments of what eventually turns out to be a larger polyhedron. The completed module cannot be readily broken down and reformed into other shapes. Typically, the finished module is used only as a decorative device.

SUMMARY OF THE INVENTION

An object of this invention relates to an improved foldable structure that can be used and reused to generate different forms and shapes.

A further object of the present invention is to provide a foldable structure which by virtue of its construction can be easily manipulated to create infinite numbers of geometric patterns.

A still further object of the present invention is to provide a foldable structure that is visually exciting and pleasing to the eye.

A yet further object of the present invention is to provide a foldable structure that is simple to construct and which is not susceptible to breakage.

It is also an object of this invention to provide a chain formed of a plurality of individual units whereby the shape of the units as well as the configuration of the chain can be independently altered to create a wide variety of visually pleasing patterns.

Another object of the present invention is to provide an easily portable amusement device that can be manipulated to create any number of shapes.

These and other objects of the present invention are attained by means of a manipulatable structure that includes a plurality of units containing a plurality of rhombic-shaped panels that are hinged together along their oblique side edges to form a collapsible enclosure that can be folded in one of two available planes to create a two dimensional pattern or any number of three dimensional structures. The units are further hinged together along abutting oblique corners to establish a linear chain of symmetrically joined units or a randomly dispersed chain of asymmetrically joined units.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

According to the present invention there is provided a foldable structure that, by virtue of its construction, offers the user a great deal of flexibility to selectively shape and reposition the individual units making up the structure into a wide number of different patterns. With specific reference now to the figures, it should be noted that the structures shown are illustrative of only two embodiments of the present invention and are herein presented to provide the most useful and readily understandable description of the invention. No attempt has been made to show unnecessary structural details of the device. The present description, when taken in light of the accompanying drawings, should, however, make it apparent to one skilled in the art how several and different forms of the invention may be developed in practice which come within the scope of the present claims.

Figure 1:
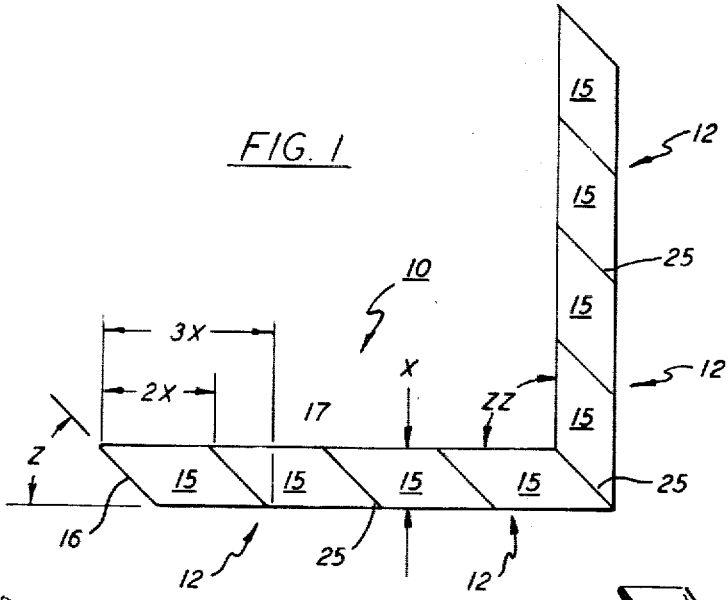
FIG. 1 is a side elevation of a foldable, chain-like structure of linear construction that embodies the teachings of the present invention showing the structure folded into a flat plane.
Figure 2:
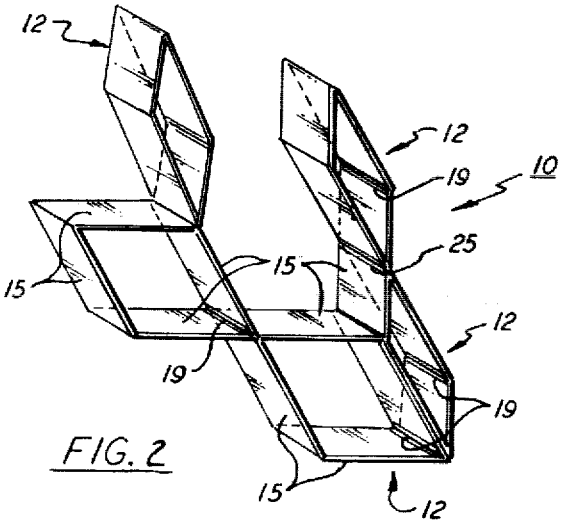
FIG. 2 is a perspective view of a structure similar to that shown in FIG. 1 with the shape of the individual units making up the unit altered and the units randomly dispersed along the chain.
Figure 3:
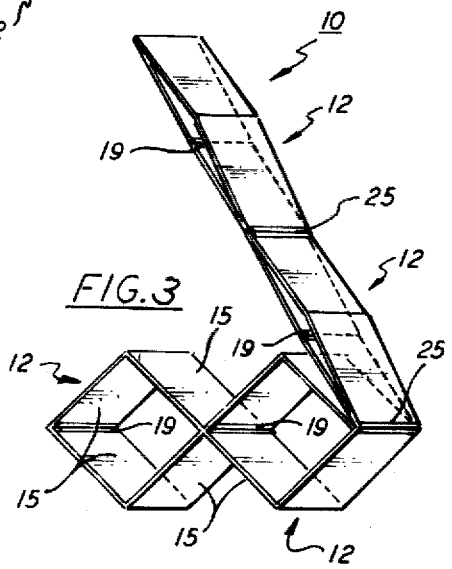
FIGS. 3 and 4 are also perspective views of the chain shown in FIG. 1 illustrating various configurations thereof.
Figure 4:
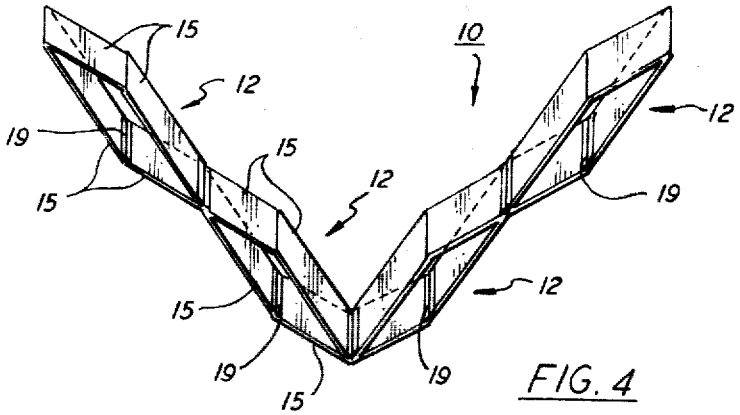

As illustrated in FIGS. 1, 3 and 4, the foldable structure of the present invention, which is generally referenced 10, is made up of a plurality of individual, substantially enclosed, units 12 that are joined together in assembly to form a chain-like arrangement of parts. Although the illustrated structure contains four individual units that are joined to form a general linear chain, it should be understood, the number of units can be either increased or decreased and joined in a non-linear, random, progression as shown in FIG. 2 without departing from the teachings of the present invention.

Each unit in the chain contains four panels 15—15 of the same size and shape that are linked together to create an enclosure having an open top and bottom. Here again, the number of panels making up each unit is not restricted to the number shown and any suitable number of panels may be brought together to form the subject enclosure.

Accordingly, by turning the panels about the internal hinges 19—19, the shape of the enclosure can be changed from a two dimensional pattern, as when the panels are folded back upon themselves in either of the two extreme positions, or any number of three dimensional structures which can be formed therebetween. In one extreme position, the panels are placed in a face to face relationship as shown in FIG. 1 to create a linear pattern. In the other extreme position, the panels are folded one on top of the other to form a flat diamond.

Although not shown, each internal hinge assembly preferably includes a friction mechanism that is arranged to act between two pivotably joined panels to exert a holding force therebetween. In one form of the invention, the biasing mechanism can be a simple rubber washer surrounding a hinge pin that is arranged to apply a holding pressure against hinge plates fastened to each of the co-joined panels. In practice, the friction load placed upon the hinge is great enough to support the weight of the panels without displacing the hinge whereby the panels tend to remain in whatever position they are placed. The friction load, however, is low enough to allow the panels to be manually repositioned and/or manipulated without binding or the need to use excessive force.

The individual units, in turn, are joined together in assembly to create either a linear or non-linear chain-like structure as shown in the drawings. Exterior hinges 25—25 are utilized to join together each adjacent unit in the chain. As in the case of the interior hinges, the hinge plates of the exterior hinges are mounted along adjacent oblique corners of cojoined units whereby the axis of each hinge lies along the common linear edge described by the two abutting oblique corners. Here again, the exterior hinges are provided with a friction device as described above to apply a predetermined load between the hinge plates to hold the units in a given position. The cojoined corners may be positioned to permit units to be aligned in a straight line or, alternatively, the corners can be reversed whereby the line of direction of the chain is abruptly changed by ninety degrees as illustrated at (ZZ) in FIG. 1.

As can be seen, by virtue of the present construction, two distinct mechanisms are provided by which the configuration of the chains may be altered. First, each of the individual units may be manipulated individually to change both its dimension and shape. Secondly, the relative position of each unit in respect to an adjacent unit can also be altered to provide an infinite number of pleasing and decorative designs.

The preferred angle (Z), as shown in FIG. 1, between the base of each panel and one of its oblique side edges is about 45°. It should be evident, however, from the disclosure above, that this base angle may vary without departing from the teaching of the present invention. Similarly, aesthetically pleasing and easily manipulatable units can be constructed by making the length of the base substantially equal to twice the height of the panel.

Although any suitable material might be used to form the panels, transparent or translucent plastic panels of various colors and tones can be effectively used to generate visually pleasing effects particularly when light shines through the device. Paper or thin gauge cardboard may also be used to make relatively inexpensive yet highly suitable units. For example, when using paper panels in a four panel unit as herein disclosed, a single pair of internal hinges may be utilized in place of the four shown. In this embodiment two rhombic-shaped sheets are used to create each unit. A fold line is scored in each sheet that is parallel with the two oblique edges and which further bisects the top and base of the panel. In assembly the two sheets are aligned in a face to face relationship and the complimentary oblique side edges of the two panels are internally hinged to create the desired enclosed structure. As can be seen, the fold lines and the hinges cooperate to permit the unit to be folded easily between the two extreme positions as noted above.

As should be evident from the disclosure above, the apparatus of the present invention can be used to create both flat, two dimensional, patterns as well as three dimensional shapes. Because of the unique characteristics of the rhombic panels, the device makes an ideal learning toy for children, a novelty item for people of all ages, or a model suitable for use by artists, designers and the like. Although the hinged arrangement is preferred, the individual panels may also be provided with snap-on fasteners that would enable the panels to be joined together whereby various shapes and forms can be created which do not necessarily have to be in a chain configuration.

While this invention has been described with reference to the details as set forth above, it is not limited to the specific structure as disclosed and the invention is intended to cover any modifications or changes as may come within the scope of the following claims.

I claim:

1. A foldable structure that includes a plurality of foldable units that are cojoined to form a chain, each unit being made up of a plurality of rhombic-shaped panels that are hinged along abutting oblique side edges by first hinge means to form a foldable enclosure having an open top and bottom so that the panels can be collapsed upon themselves in one direction to form a flat four-sided structure and in a second direction to form a a flat multi-sided structure having a central opening describing a polygon having a number of sides equal in number to the number of panels contained in the unit, and which further includes second hinge means for connecting each adjacent unit in the chain along abutting oblique side edges whereby the shape of each unit in the chain may be changed between the two noted flat positions as well as the relative position of each adjacent unit along the chain.

2. The foldable structure of claim 1 wherein at least one of the first hinge means associated with each unit contains a friction means for holding the panels in a desired position.

3. The foldable structure of claim 3 wherein the second hinge means acting between each adjacent unit has a friction means for holding the cojoined units at a desired position.

4. The foldable structure of claim 1 wherein at least four rhombic-shaped panels are employed in each unit.

5. The foldable structure of claim 4 wherein the oblique side edge of each panel forms an angle of about 45° with the base of said panel.

6. The foldable structure of claim 5 wherein the length of the base is about twice the height of the panel.

7. The foldable structure of claim 1 wherein said panels are formed of a light-transmitting plastic.

* * * * *